US007850627B2

(12) United States Patent
Woo et al.

(10) Patent No.: US 7,850,627 B2
(45) Date of Patent: Dec. 14, 2010

(54) EXERCISE MACHINE

(75) Inventors: Ki Chul Woo, Seoul (KR); Jin Ho Chang, Seoul (KR); Seon Woong Hwang, Seoul (KR); Hyung Kyu Youk, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 12/504,355

(22) Filed: Jul. 16, 2009

(65) Prior Publication Data

US 2010/0016124 A1 Jan. 21, 2010

(30) Foreign Application Priority Data

Jul. 17, 2008 (KR) ..... 10-2008-0069675

(51) Int. Cl.
*A61H 1/00* (2006.01)

(52) U.S. Cl. ..... 601/86; 601/90; 482/51; 482/148

(58) Field of Classification Search ..... 482/51, 482/77, 148; 601/23, 24, 26, 49–51, 53, 601/86, 87, 90, 91, 98, 100; 434/35, 46, 434/55, 225, 247; 472/59, 83, 84, 95–97, 472/130, 135; 273/449; 446/230, 231; 297/260.1, 297/260.2

See application file for complete search history.

(56) References Cited

U.S. PATENT DOCUMENTS 5,884,524 A * 3/1999 Lo ..... 74/42
6,315,673 B1 * 11/2001 Kopera et al. ..... 472/60
6,402,626 B1 * 6/2002 Beaty ..... 472/96
6,866,594 B2 * 3/2005 Greenwood ..... 473/422
6,964,614 B1 11/2005 Tsai
7,070,415 B2 * 7/2006 Hojo et al. ..... 434/247
7,104,927 B2 * 9/2006 Tsai ..... 482/51
7,121,831 B2 10/2006 Hojo et al.
7,338,412 B2 * 3/2008 Nakanishi ..... 482/51
7,338,413 B2 3/2008 Nakanishi
7,347,806 B2 * 3/2008 Nakano et al. ..... 482/51
7,448,953 B2 * 11/2008 Chen ..... 472/96
7,458,923 B1 * 12/2008 Chou ..... 482/142
7,608,017 B2 * 10/2009 Nakanishi ..... 482/51
7,670,230 B2 * 3/2010 Hsu ..... 472/58
7,682,154 B2 * 3/2010 Hojo et al. ..... 434/247
2006/0088808 A1 4/2006 Tsai
2006/0229170 A1 * 10/2006 Ozawa et al. ..... 482/92
2007/0179022 A1 * 8/2007 Chen ..... 482/51
2007/0207900 A1 * 9/2007 Huang et al. ..... 482/51
2009/0005186 A1 * 1/2009 Tseng ..... 472/97

FOREIGN PATENT DOCUMENTS

EP 1 884 266 A2 2/2008

* cited by examiner

*Primary Examiner*—Patricia M Bianco
*Assistant Examiner*—Victor K Hwang
(74) *Attorney, Agent, or Firm*—Birch, Stewart, Kolasch & Birch, LLP

(57) ABSTRACT

An exercise machine is provided. The exercise machine includes a support defining a longitudinal direction and a transverse direction, a first motion unit coupled to the support to provide a combined translational and pivotal movement of the first motion unit in the transverse direction, a second motion unit coupled to the first motion unit to provide one of a translational movement and a pivotal movement of the second motion unit in the longitudinal direction, and a driving source configured to impart movement to the first and second motion units.

13 Claims, 6 Drawing Sheets

EXERCISE MACHINE

CROSS-REFERENCE TO RELATED APPLICATIONS

This application claims priority to Korean Application No. 10-2008-0069675, filed Jul. 17, 2008, which is herein incorporated by reference in its entirety.

BACKGROUND OF THE INVENTION

1. Field of the Invention

The present invention relates to an exercise machine, and more particularly, to an exercise machine which performs translational reciprocating motions and pivotal reciprocating motions in plural directions.

2. Description of Related Art

These days, many people are interested in health care, health maintenance, and health promotion. In addition, many people receive a diagnosis or advice of a doctor, in medical facilities such as hospitals, for the purpose of early detection or prevention of a disease, and these people often seek health care, health maintenance, or health promotion using non-medical facilities such as a sports club.

Further, exercise machines, for example, a running machine, a stepping device, and an indoor bicycle, for maintaining or promoting one's health and physical strength are widely used.

BRIEF SUMMARY OF THE INVENTION

The present invention has been made in an effort to solve the above problems, and the present invention provides an exercise machine for performing a translational reciprocating motion and a pivotal reciprocating motion using a translational reciprocating motion direction as a rotation axis.

The present invention further provides an exercise machine for performing a pivotal reciprocating motion in which the rotation axis changes.

The present invention further provides an exercise machine that can change or stop a motion using a clutch.

The object of the present invention is not limited to the above-described objects and the other objects will be clearly understood by those skilled in the art from the following description.

According to an aspect of the present invention, there is provided an exercise machine including a support defining a longitudinal direction and a transverse direction, a first motion unit coupled to the support to provide a combined translational and pivotal movement of the first motion unit in the transverse direction, a second motion unit coupled to the first motion unit to provide one of a translational movement and a pivotal movement of the second motion unit in the longitudinal direction, and a driving source configured to impart movement to the first and second motion units.

According to another aspect of the present invention, there is provided an exercise machine including a support defining a longitudinal direction and a transverse direction, a first motion unit coupled to the support to provide a combined translational and pivotal movement of the first motion unit in the transverse direction, a second motion unit coupled to the first motion unit to provide one of a translational movement and a pivotal movement of the second motion unit in the longitudinal direction, and a driving source configured to impart movement to the first and second motion units. The first motion unit may include a first main body, and a pair of linkage arms connecting the first main body to the support, the combination of the pair of linkage arms, the first main body, and the support form a four-bar linkage.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The present invention will become more fully understood from the detailed description given hereinbelow and the accompanying drawings, which are provided for illustration purposes only, and thus are not limitative of the present invention, and wherein.

DETAILED DESCRIPTION OF THE INVENTION

Figure 1:
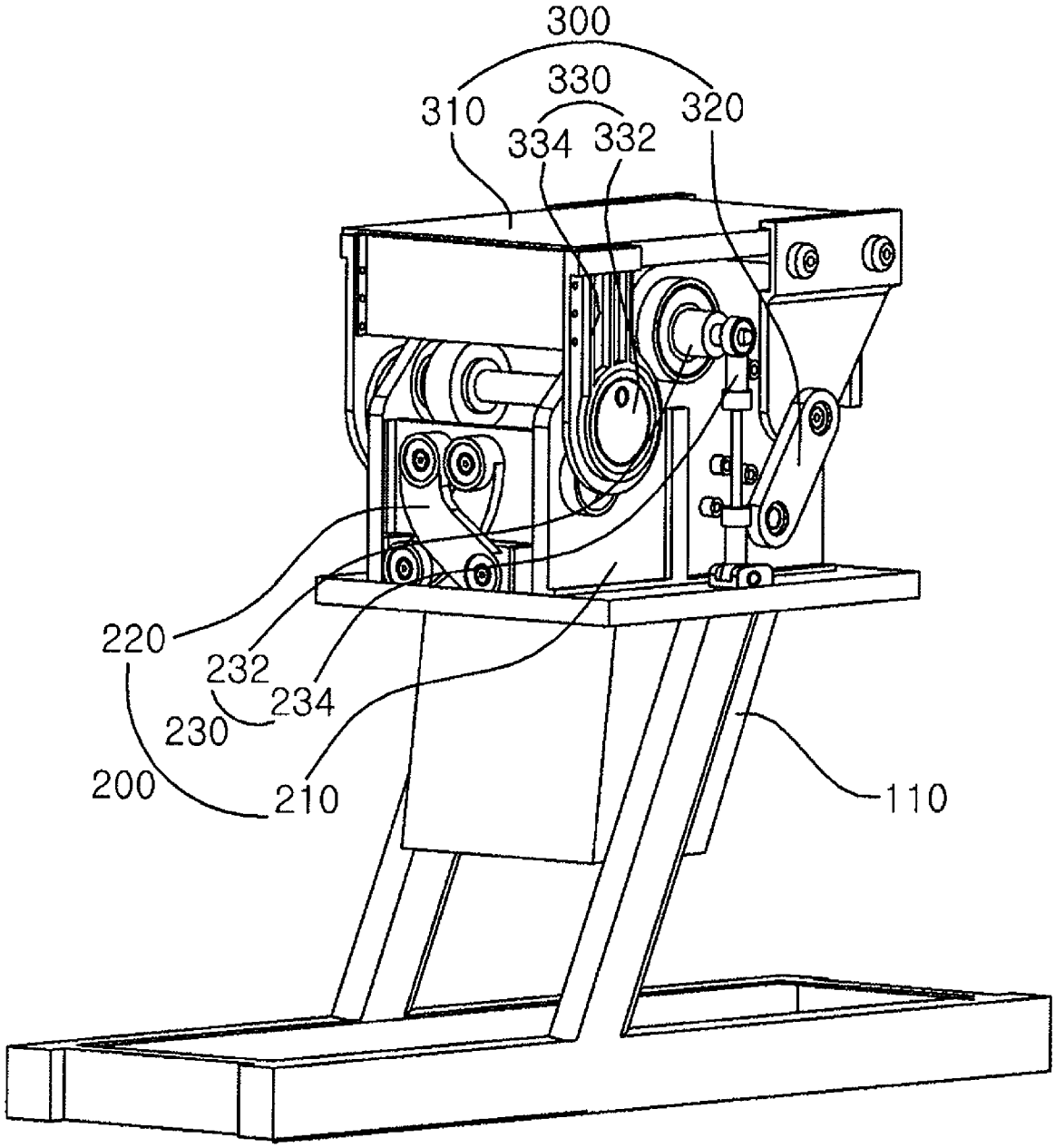
FIG. 1 shows a right front perspective view of an exercise machine according to an exemplary embodiment of the present invention.
Figure 2:
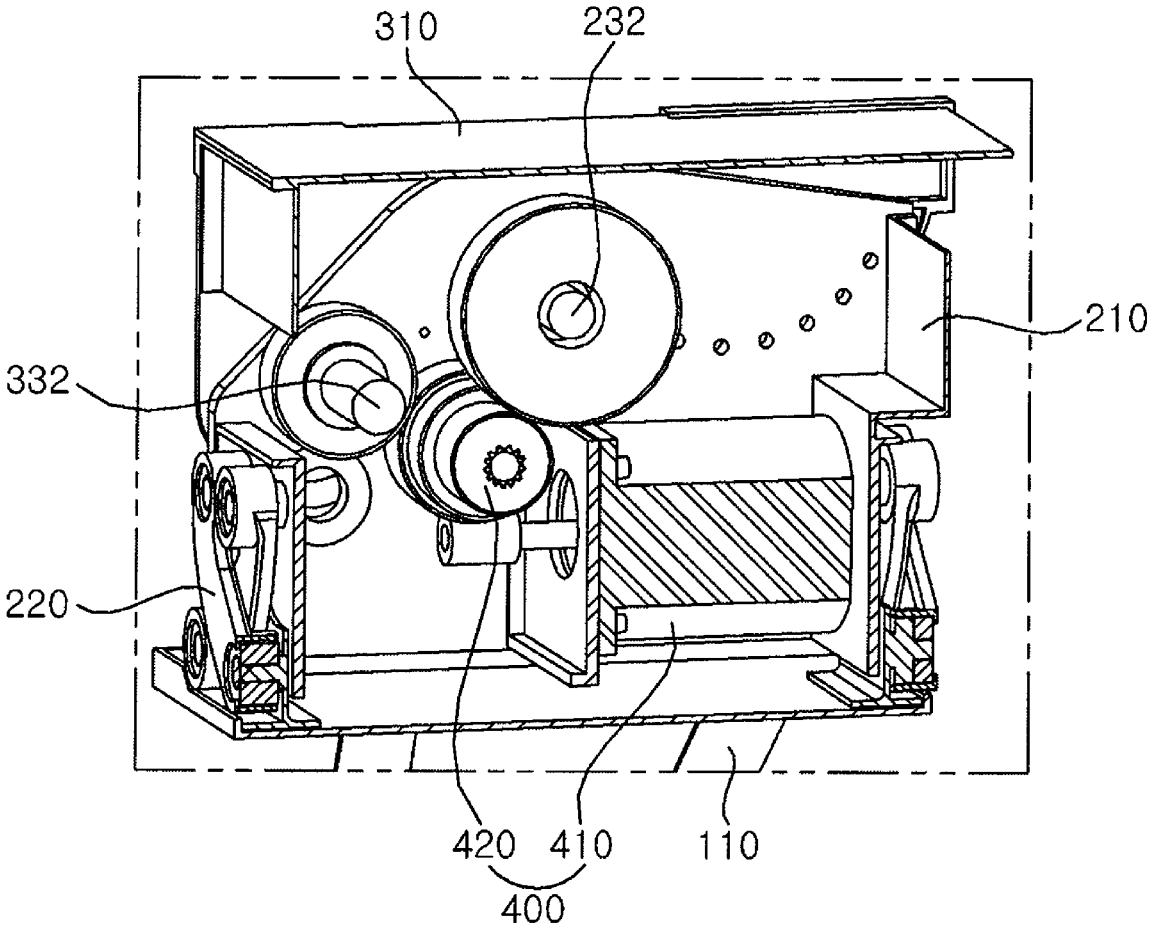
FIG. 2 shows a cross-sectional view of the exercise machine of FIG. 1.

These and other objects of the present invention will become more readily apparent from the detailed description given hereinafter together with the attached drawings. However, the present invention is not limited to the detailed description given hereinafter, but can be embodied in various forms. It should be understood that the detailed description and specific examples, while indicating preferred embodiments of the invention, are given by way of illustration only, since various changes and modifications within the spirit and scope of the invention will become apparent to those skilled in the art from this detailed description. Therefore, the scope of the invention is defined not by the detailed description of the invention but by the appended claims, and all differences within the scope will be construed as being included in the present invention. Like reference numerals designate like elements throughout the specification.

Hereinafter, exemplary embodiments according to the present invention will be described in detail with reference to the accompanying drawings.

Referring to FIG. 1, the exercise machine according to the present exemplary embodiment includes a support 110, a first motion unit 200 coupled to the support 110 to perform combined translational and pivotal reciprocating motions, a second motion unit 300 coupled to the first motion unit 200 to perform at least one of translational and pivotal reciprocating motions, and a driver 400 for driving the first motion unit 200 and the second motion unit 300.

The support 110 supports the first motion unit 200 and the second motion unit 300. It is preferable that the support 110 supports the exercise machine at the floor in a way that reduces shaking when the first motion unit 200 and the second motion unit 300 perform reciprocating motions. Further, the support 110 should support the exercise machine to prevent the exercise machine from falling when a person sits at the upper side of the second motion unit 300 and the exercise machine is in operation. It is preferable that the support 110 has a long foothold to support the exercise machine at the floor.

The first motion unit 200 is coupled to the support 110 to perform translational and pivotal reciprocating motions in a transverse (side-to-side) direction. The first motion unit 200 is coupled to the support 110 to perform a pivotal reciprocating motion in which the pivot axis changes in the transverse direction. The first motion unit 200 performs a translational reciprocating motion as the pivot axis of the pivotal reciprocating motion changes. Accordingly, the first motion unit 200 performs a combined translational reciprocating motion in the transverse direction and pivotal reciprocating motions in the transverse direction. Further, the first motion unit 200 performs a reciprocating motion in a vertical direction.

The first motion unit 200 includes a first motion main body 210 provided at the upper side of the support 110, a first transmission unit 230 for transferring the rotary power of the driver 400 to convert the rotary power to a reciprocating motion, and a first coupling unit 220 for connecting the first motion main body 210 to the support 110 so that the first motion main body 210 performs the combined translational and pivotal reciprocating motion in the transverse direction.

The first motion main body 210 is provided at the upper side of the support 110 and forms a main body of the first motion unit 200. The driver 400 for generating the rotary power is provided within the first motion main body 210. In the described embodiment, the first motion main body 210 is pivotally coupled to the first transmission unit 230. The first motion main body 210 performs a pivotal reciprocating motion by being coupled to the first coupling unit 220.

The first transmission unit 230 transfers the rotary power of the driver 400 and converts the rotary power to a reciprocating motion. In the described embodiment, only a single transmission unit 230 is provided at the left side or the right side of the first motion main body 210. The first transmission unit 230 will be described later in detail with reference to FIGS. 3 and 4.

The first coupling unit 220 connects the first motion main body 210 to the support 110 so that the first motion main body 210 performs a translational and pivotal reciprocating motion in a transverse direction. The first coupling unit 220 is formed with a plurality of revolute joints and the first motion main body 210 performs a pivotal reciprocating motion while changing the pivot axis in a transverse direction.

The first coupling unit 220 allows the first motion main body 210 to perform a pivotal reciprocating motion as well as a translational reciprocating motion in a transverse direction. Further, the first coupling unit 220 allows the first motion main body 210 to perform a reciprocating motion in a vertical direction.

In the described embodiment, the first coupling unit 220 may be formed as a four-bar linkage or a crossed four-bar linkage. For example, the first coupling unit 220 includes a pair of linkage arms, and the combination of the pair of linkage arms, the first main body 210, and the support 110 forms either a four-bar linkage or a crossed four-bar linkage. While the described embodiment shows the first coupling unit 220 at a front of the first motion main body 210, the first coupling unit 220 may be formed at a rear of the first motion main body 210. Alternatively, two first coupling units 220 may be provided, one at the front and the other at the rear of the first motion main body 210. The first coupling unit 220 will be described later in detail with reference to FIGS. 5(*a*) and 5(*b*).

The second motion unit 300 performs at least one of a translational and a pivotal reciprocating motion in the longitudinal (front-rear) direction. For convenience, further description of the motion of the second motion unit 300 will be referred to as translational and pivotal reciprocating motion, but it is understood that only one of translational and pivotal motion need be provided. The second motion unit 300 includes a second motion main body 310 provided at the upper side of the first motion main body 210, a second coupling unit 320 for coupling the second motion unit 300 to the first motion main body 210 so that the second motion main body 310 performs a translational and pivotal reciprocating motion, and a second transmission unit 330 for transferring the rotary power of the driver 400 to convert the rotary power to a reciprocating motion.

The second motion main body 310 is provided at the upper side of the first motion main body 210, is fixedly coupled to the second transmission unit 330, and is coupled to the first motion main body 210 by the second coupling unit 320. The second motion main body 310 performs translational and pivotal reciprocating motion in the longitudinal direction and performs a reciprocating motion in the vertical direction. A seat in which a person can sit is provided at the upper side of the second motion main body 310.

The second transmission unit 330 transfers the rotary power of the driver 400 to convert the rotary power to a reciprocating motion. The second transmission unit 330 includes an eccentric wheel 332 for receiving the rotary power from the driver 400, and a second motion shaft 334 having one end rotatably coupled to the eccentric wheel 332 and the other end fixedly coupled to the second motion main body 310. The second transmission unit 330 is provided in plural numbers and is provided at the left side and the right side of the second motion main body 310.

The eccentric wheel 332 receives the rotary power from the driver 400. The eccentric wheel 332 is coupled to the driver 400 by a gear to receive the rotary power and may be coupled to a pulley by a belt to receive the rotary power. The eccentric wheel 332 is rotatably coupled to one end of the second motion shaft 334 to eccentrically rotate, thereby converting a rotation motion to a reciprocating motion. The other end of the second motion shaft 334 is fixedly coupled to the second motion main body 310. As a result, a reciprocating motion of the second motion shaft 334 is transferred to the second motion main body 310 and the second motion main body 310 performs a reciprocating motion.

The second coupling unit 320 couples the second motion main body 310 and the first motion main body 210 so that the second motion main body 310 performs a translational and pivotal reciprocating motion in the longitudinal direction. The second coupling unit 320 is formed with a one-bar linkage having one end pivotally coupled to the second motion main body 310 and the other end pivotally coupled to the first motion main body 210. The second coupling unit 320 is provided in plural numbers and is provided at the left side and the right side of the second motion main body 310.

In the described embodiment, the driver 400 is provided in the first motion unit 200 to generate the rotary power, thereby driving the first motion unit 200 and/or the second motion unit 300. In the present exemplary embodiment, the driver 400 simultaneously drives the first motion unit 200 and the second motion unit 300; however, it is understood that the driver 400 may be provided in plural numbers to drive each of the first motion unit 200 and the second motion unit 300 independently. The rotary power of the driver 400 is transferred to each of the first motion unit 200 and/or the second motion unit 300 and is converted to a reciprocating motion, whereby the first motion unit 200 and/or the second motion unit 300 perform a translational and a pivotal reciprocating motion. The driver 400 includes a motor 410 for generating the rotary power and a gear unit 420 for changing a rotation axis direction of the rotary power generated by the motor 410 to an orthogonal direction.

The motor 410 is provided in the first motion main body 210 to generate the rotary power. The gear unit 420 may be formed with a bevel gear or a screw gear to change a rotation axis direction of the rotary power generated by the motor 410 to an orthogonal direction. The gear unit 420 is coupled to a rotation shaft 232 and the eccentric wheel 332 by a gear and transfers the rotary power to each of the rotation shaft 232 and the eccentric wheel 332. In the present exemplary embodiment, the motor 410 and the gear unit 420 simultaneously drive the first motion unit 200 and the second motion unit 300; however, it is understood that the motor 410 and the gear unit 420 may be provided in plural numbers to drive each of the first motion unit 200 or the second motion unit 300 separately.

Figure 3:
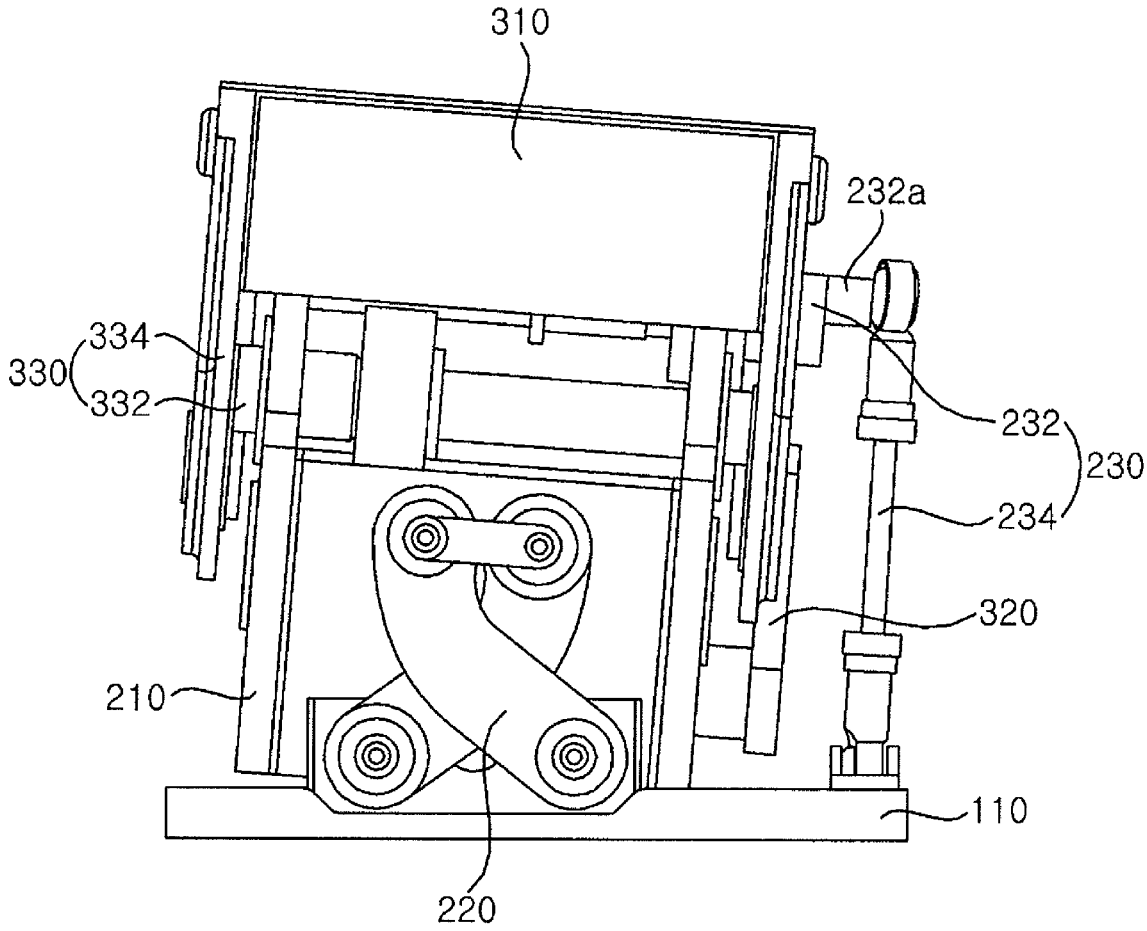
FIGS. 3 and 4 show front views demonstrating the operation of a first motion unit of the exercise machine of FIG. 1.
Figure 4:
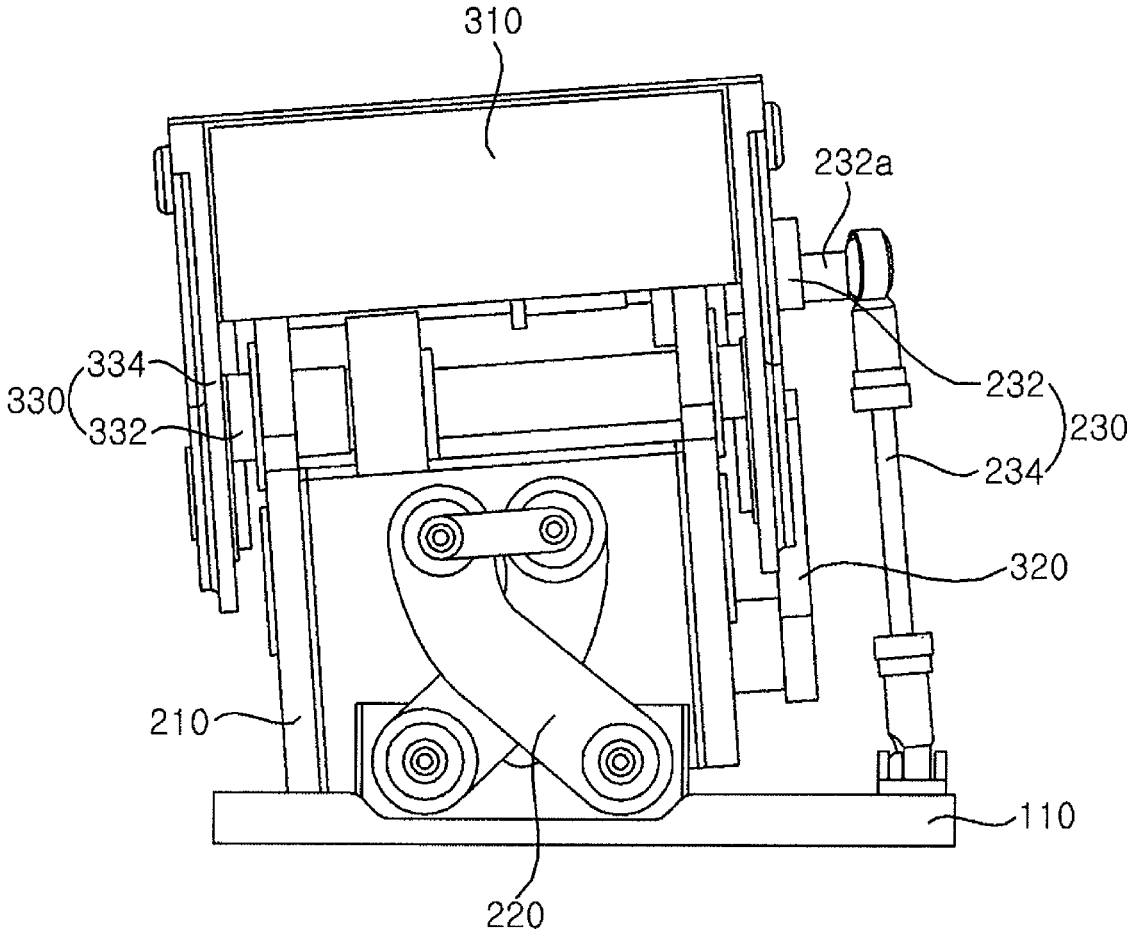

As seen in FIGS. 3 and 4, the first transmission unit 230 includes the rotation shaft 232 for receiving the rotary power from the driver 400, an eccentric pin 232*a* formed at the rotation shaft, and a first motion shaft 234 having one end pivotally coupled to the eccentric pin 232*a* of the rotation shaft 232 and the other end pivotally coupled to the support 110. While the rotation shaft 232 of the exemplary embodiment is shown as being coupled to the driver 400 by a gear to receive the rotary power, it is understood that other means can be used to couple the rotation shaft 232 and the driver 400, such as, for example, by being coupled to a belt by a pulley to receive the rotary power.

The rotation shaft 232 has the eccentric pin 232*a* at one end thereof. Because the rotation shaft 232 has the eccentric pin 232*a*, which eccentrically rotates, the rotation shaft 232 converts a rotation motion to a reciprocating motion. The eccentric pin 232*a* of the rotation shaft 232 is pivotally coupled to the first motion shaft 234. In particular, one end of the first motion shaft 234 is pivotally coupled to the eccentric pin 232*a* of the rotation shaft 232 by a universal joint. The other end of the first motion shaft 234 is pivotally coupled to the support 110 by a universal joint. It is understood that other joints that allow for pivoting motion can be used in place of the universal joints.

When the rotation shaft 232 receives the rotary power from the driver 400, the eccentric pin 232*a* eccentrically rotates. Because the first motion shaft 234 is pivotally connected to both the eccentric pin 232*a* and the support 110, the first motion shaft 234 converts the rotary power from the eccentric pin 232*a* to a reciprocating motion. Therefore, the first motion main body 210 performs a reciprocating motion.

The first motion main body 210 is coupled to the support 110 by the first coupling unit 220. The first coupling unit 220 includes a pair of linkage arms, and the combination of the pair of linkage arms, the first main body 210, and the support 110 form a four-bar linkage. In this exemplary embodiment, the four-bar linkage is a crossed four-bar linkage to allow the first motion main body 210 to perform a translational and pivotal reciprocating motion in a transverse direction.

Figure 5:
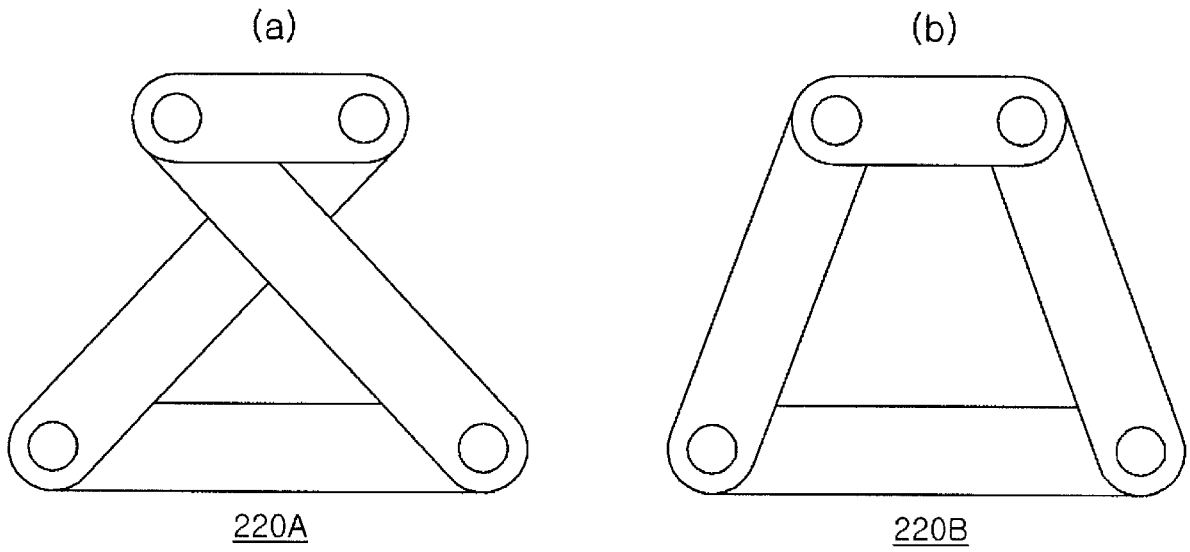
FIGS. 5(*a*) and 5(*b*) show schematic views of alternative arrangements of a first coupling unit of the exercise machine according to an exemplary embodiment of the present invention.

As seen in FIGS. 5(*a*) and 5(*b*), the first coupling unit 220, in combination with the first main body 210, and the support 110 may form either a crossed-four bar linkage 220A (FIG. 5(*a*)) or a four bar linkage 220B (FIG. 5(*b*)). The crossed four-bar linkage 220A performs a large pivotal reciprocating motion and a small translational reciprocating motion while the four-bar linkage 220B performs a small pivotal reciprocating motion and a large translational reciprocating motion. Accordingly, it is understood that the crossed four-bar linkage 220A can be used to increase a pivotal reciprocating motion of the first motion main body 210 and the four-bar linkage 220B can be used to increase a translational reciprocating motion of the first motion main body 210.

The exercise machine according to the present invention having the above-described configuration operates as follows. When the motor 410 of the driver 400 rotates, the gear unit 420 changes a rotation axis direction of the rotary power generated by the motor 410 to an orthogonal direction and transfers the rotary power to each of the rotation shaft 232 and the eccentric wheel 332. Next, the rotation shaft 232 receives the rotary power from the gear unit 420, thereby causing the eccentric pin 232*a* of the rotation shaft 232 to eccentrically rotate. The first motion shaft 234 coupled to the eccentric pin 232*a* of the rotation shaft 232 by an universal joint performs a reciprocating motion as the eccentric pin 232*a* eccentrically rotates. Because the first motion shaft 234 is coupled to the support 110 by an universal joint and the first motion main body 210 is coupled to the support 110 by the first coupling unit 220, which forms a crossed four-bar linkage, the first motion main body 210 performs a translational and pivotal reciprocating motion in a transverse direction when the first motion shaft 234 performs a reciprocating motion.

At the same time that the first motion shaft 234 is reciprocating, the eccentric wheel 332 receives the rotary power from the gear unit 420 to eccentrically rotate. The second motion shaft 334 is pivotally coupled to the eccentric wheel 332 to convert a rotation motion to a reciprocating motion. Because the second motion shaft 334 is fixedly coupled to the second motion main body 310, and the second motion main body 310 is coupled to the first motion main body 210 by the second coupling unit 320, which is a one-bar linkage, the second motion main body 310 performs a pivotal reciprocating motion in the longitudinal direction. The effect of the combined motions of the first motion unit 200 and the second motion unit is to provide both roll and pitch movements to a ride. It is understood that if the support is set at an angle with respect to a horizontal plane, that a portion of the pitch movement will converted to a yaw motion.

Figure 6:
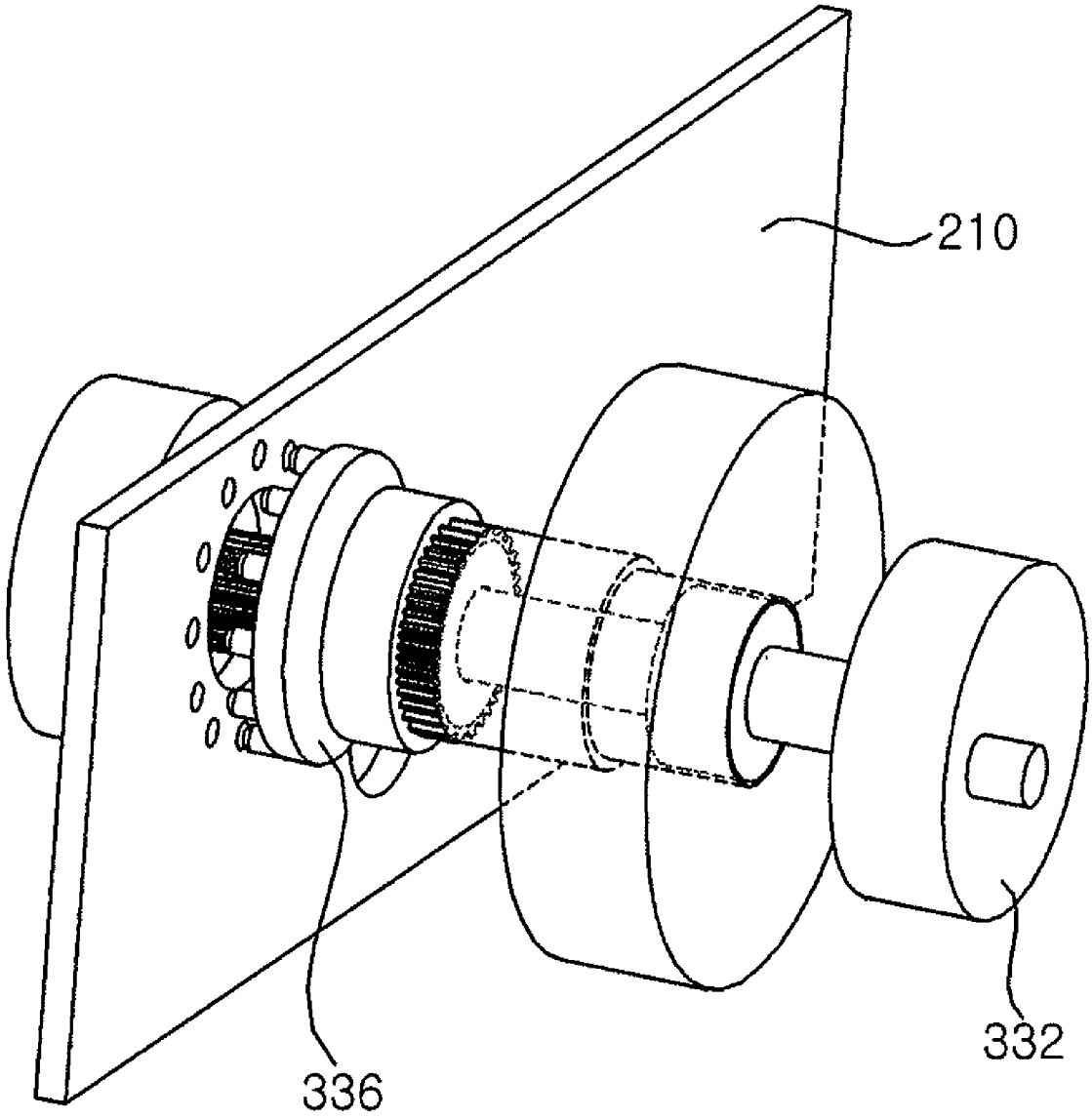
FIG. 6 shows a perspective view of a clutch for an exercise machine according to another exemplary embodiment of the present invention.

As seen in FIG. 6, an exercise machine according to another exemplary embodiment includes a first clutch (not shown) for intercepting the rotary power transferred from the driver 400 to the first motion unit 200, or a second clutch 336 for intercepting the rotary power transferred to the second motion unit 300. With reference to FIG. 4, the second clutch 336 may be provided at the eccentric wheel 332 of the second transmission unit 330 to intercept the rotary power transferred from the driver 400. Therefore, the second clutch 336 allows the second transmission unit 330 to be connected to a gear assembly, such as a gear train or gear box, to provide different gear ratios, or to fix the second transmission unit 330 by intercepting the rotary power, thereby changing or stopping a motion of the second motion main body 310. Similarly, the first clutch (not shown) may be provided in the rotation shaft 232 of the first transmission unit 230, thereby changing or stopping a motion of the first motion main body 210.

The exercise machine according to the present invention provides the following effects. First, a translational reciprocating motion and a pivotal reciprocating motion using a translational reciprocating motion direction as a rotation axis can be performed. Second, a pivotal reciprocating motion in which the rotation axis changes can be performed. Third, a motion can be changed or stopped using a clutch. Fourth, both a pivotal reciprocating motion and a translational reciprocating motion can be performed using a four-bar linkage.

The effect of the present invention is not limited to the above-described effects and the other effects will be clearly understood by those skilled in the art from the claims.

The embodiment of the invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An exercise machine comprising:

a support defining a longitudinal direction and a transverse direction;

a first motion unit coupled to the support to provide a combined translational and pivotal movement of the first motion unit in the transverse direction, the first motion unit including:

a first main body; and a pair of linkage arms connecting the first main body to the support, the combination of the pair of linkage arms, the first main body, and the support forming a four-bar linkage;

a second motion unit coupled to the first motion unit to provide one of a translational movement and a pivotal movement of the second motion unit in the longitudinal direction; and a driving source configured to impart movement to the first and second motion units.

2. The exercise machine of claim 1, wherein the four-bar linkage is a crossed four-bar linkage.

3. The exercise machine of claim 1, wherein the second motion unit includes a second main body and a second coupling unit connecting the second main body to the first main body.

4. The exercise machine of claim 1, further comprising a first transmission unit connecting the driving source to the first motion unit.

5. The exercise machine of claim 4, wherein the driving source includes an output shaft, and wherein the first transmission unit includes:

a rotation shaft connected to the output shaft to receive power from the output shaft, the rotation shaft including an eccentric pin projecting from the rotation shaft; and a first motion shaft, the first motion shaft having a first end connected to the eccentric pin and a second end pivotally connected to the support.

6. The exercise machine of claim 5, further comprising a second transmission unit connecting the driving source to the second motion unit.

7. The exercise machine of claim 6, wherein the second transmission unit includes:

an eccentric wheel connected to the output shaft to receive power from the output shaft; and a second motion shaft, the second motion shaft having a first end pivotally connected to the eccentric wheel and a second end fixedly coupled to the second motion unit.

8. The exercise machine of claim 7, wherein the rotation shaft and the eccentric wheel are connected to the output shaft through a gear unit.

9. The exercise machine of claim 4, further comprising a second transmission unit connecting the driving source to the second motion unit.

10. The exercise machine of claim 1, wherein the second motion unit is coupled to the first motion unit to provide a combined translational and pivotal movement of the second motion unit in the longitudinal direction.

11. The exercise machine of claim 1, wherein the second motion unit includes:

a second main body; and a second coupling unit connecting the second main body to the first main body, the second coupling unit including a linkage having a first end pivotally connected to the second main body and a second end pivotally connected to the first main body.

12. The exercise machine of claim 11, further comprising:

a first transmission unit connecting the driving source to the first motion unit; and a second transmission unit connecting the driving source to the second motion unit.

13. The exercise machine of claim 12, wherein the driving source includes an output shaft, the first transmission unit includes:

a rotation shaft connected to the output shaft to receive power from the output shaft, the rotation shaft including an eccentric pin projecting from the rotation shaft; and a first motion shaft, the first motion shaft having a first end connected to the eccentric pin and a second end pivotally connected to the support, and the second transmission unit includes:

an eccentric wheel connected to the output shaft to receive power from the output shaft; and a second motion shaft, the second motion shaft having a first end pivotally connected to the eccentric wheel and a second end fixedly coupled to the second motion unit.

* * * * *